US010743096B2

(12) United States Patent
Shymanovych et al.

(10) Patent No.: US 10,743,096 B2
(45) Date of Patent: Aug. 11, 2020

(54) HEADPHONES OR A HEADSET WITH A PLANAR MAGNETIC SYSTEM

(71) Applicant: Pavlo Olegovych Shymanovych, Lviv (UA)

(72) Inventors: Pavlo Olegovych Shymanovych, Lviv (UA); Kostyantyn Kostyantynovych Baklayev, Lviv (UA); Eduard Olexiyovych Olexandrov, Lviv (UA)

(73) Assignee: Pavlo Olegovych Shymanovych, Lviv (UA)

( * ) Notice: Subject to any disclaimer, the term of this patent is extended or adjusted under 35 U.S.C. 154(b) by 0 days.

(21) Appl. No.: 16/482,167

(22) PCT Filed: Feb. 27, 2018

(86) PCT No.: PCT/UA2018/000018
§ 371 (c)(1),
(2) Date: Jul. 30, 2019

(87) PCT Pub. No.: WO2018/199873
PCT Pub. Date: Nov. 1, 2018

(65) Prior Publication Data

US 2020/0007974 A1 Jan. 2, 2020

(30) Foreign Application Priority Data

Apr. 25, 2017 (UA) ..... 2017 04133

(51) Int. Cl.
*H04R 1/10* (2006.01)
*H04R 5/033* (2006.01)

(52) U.S. Cl.
CPC ..... *H04R 1/1066* (2013.01); *H04R 1/1008* (2013.01); *H04R 5/0335* (2013.01); *H04R 2201/10* (2013.01)

(58) Field of Classification Search
CPC .... H04R 1/10; H04R 2205/022; H04R 1/105; H04R 5/0335; H04R 2201/10
(Continued)

(56) References Cited

U.S. PATENT DOCUMENTS 4,302,635 A 11/1981 Jacobsen et al.
9,332,337 B2 * 5/2016 Ridler ..... H04R 1/1058
(Continued)

FOREIGN PATENT DOCUMENTS

JP 6-78386 A 3/1994
WO WO-2010/099794 A1 9/2010
WO WO-2013/062454 A1 5/2013

OTHER PUBLICATIONS

International Search Report in International Application No. PCT/UA2018/000018, filed Feb. 27, 2018.
(Continued)

*Primary Examiner* — Suhan Ni
(74) *Attorney, Agent, or Firm* — Saliwanchik, Lloyd & Eisenschenk

(57) ABSTRACT

The invention relates to the field of electrical communication, particularly to the design of headphones or headset which uses an acoustic radiator with a planar magnetic system that can be used to change ear cup cushion of headphones or headset. Headphones or the headset comprises of at least one housing with an acoustic radiator having a planar magnetic system placed therein, equipped with an ear cup cushion located on the outer surface of the radiator. The ear cup cushion and housing is performed in disconnected way. The ear cup cushion is rigidly connected to at least one acoustically transparent ferromagnetic screen connected to the housing by means of an interaction of the ferromagnetic screen with the magnetic field of the planar magnetic system on the outer surface of the radiator. The magnetic conductivity of the ferromagnetic screen is suffi-
(Continued)

cient to increase the magnetic induction in a gap of the magnetic system of the radiator and to hold the ear cup cushion with a ferromagnetic shield on the housing. When the ear cup cushion is attached to the hosing, the ferromagnetic screen located on the outer surface of the radiator increases the magnetic conductivity of the outer portion of the magnetic core of the radiator and increases the magnetic induction in the gap of the magnetic system of the radiator and, accordingly, its sensitivity.

3 Claims, 6 Drawing Sheets

(58) Field of Classification Search
USPC ..... 381/370–371, 374, 379
See application file for complete search history.

(56) References Cited

U.S. PATENT DOCUMENTS

| | | | | |
|---|---|---|---|---|
| 10,063,956 | B2 * | 8/2018 | Hardi | H04R 1/1016 |
| 2006/0222197 | A1 | 10/2006 | Tsunoda et al. | |
| 2012/0070027 | A1 | 3/2012 | Ridler | |
| 2015/0063623 | A1 | 3/2015 | Yoshida | |
| 2015/0326974 | A1 | 11/2015 | Skubinski, III et al. | |
| 2017/0085988 | A1 | 3/2017 | Hardi et al. | |

OTHER PUBLICATIONS

Ebaen, S., "Oppo PM-1 Planar Magnetic headphones review (Part 2)," *Darko*, 2014, pp. 1-7.

* cited by examiner

HEADPHONES OR A HEADSET WITH A PLANAR MAGNETIC SYSTEM

CROSS-REFERENCE TO RELATED APPLICATIONS

This application is the U.S. national stage application of International Patent Application No. PCT/UA2018/000018, filed Feb. 27, 2018; which claims the benefit under 35 U.S.C. § 119 of Ukrainian Application No. a 2017 04133, filed Apr. 25, 2017; the disclosures of each of which are incorporated herein by reference in their entirety.

FIELD OF THE INVENTION

The invention relates to the field of electrical communication, particularly to the design of headphones or a headset which uses an acoustic radiator with a planar magnetic system that can be used to change ear cup cushion of headphones or headset.

BACKGROUND OF THE INVENTION

An acoustic radiator (driver) means a device designed to excite sound waves by converting an electrical signal into a mechanical vibration of the membrane.

An acoustic radiator with a planar magnetic system means an isodynamic radiator or an orthodynamic radiator, or Heil air motion transformer, or other similar electrodynamic radiator comprising a magnetic system formed by a set of magnets and a membrane with electrically conductive tracks applied thereon. A symmetrical planar magnetic system with a magnetic core, a symmetrical planar magnetic system without a magnetic core or a single-sided planar magnetic system with a magnetic core that forms a gap between a set of magnets and a membrane can be as such magnetic system.

It is known a lot of devices of the same purpose, among which the closest are the following.

The publication of the international application WO2013062454A1 of May 2, 2013 describes design of the headphones that provides for magnetic attachment of the radiators to the supporting structure.

The application US2015063623A1 of Mar. 5, 2015 also describes design of the headphones that comprises magnetic attachment of the housing with radiators to the supporting structure with a possibility of rotating relatively to anchoring point.

The application JPH0678386 of Mar. 18, 1998 describes design of the headphones, where ear cup cushions are fastened to the cushions holder at four points by means of an adhesive tape with a possibility of their separation and subsequent cooling.

The U.S. Pat. No. 4,302,635 of Nov. 24, 1981 describes the headphones, where ear cup cushions are fastened to a housing of each of headphones also at four points by means of system of openings and hooks with a possibility to separate them in order to replace.

The application US20060222197 of Nov. 5, 2006 describes headphones design having ear cup cushions placed in a separate housing that has a part to be teared apart, and when it is closed, is attached to the headphone housing.

In all the designs above, there is no provision for use of acoustic radiators with a planar magnetic system, therefore, for a detachable design, either a mechanical fastening or an additional magnetic system is used being not connected with the acoustic radiator. Moreover, most of the devices above assume using of a magnetic system for fastening of the radiator or its housing to the supporting structure or to each other, and does not provide for replacement of only the cushions without replacing the radiator itself. Technical solutions providing for a replacement of only the ear cup cushions use only a mechanical detachable fastening which is more difficult to manufacture or use and less reliable and durable.

Substantially, the close design to the proposed technical solution is a design of headphones, wherein ear cup cushion is attached to the headphone housing due to the interaction of the magnetic part on the housing and a part of the ferromagnetic material on the ear cup cushion. In particular, the part on the ear cup cushion can be performed in the form of a ring that is located in a groove made on the ear cup cushion on a side being attached to the housing (publication of the international application WO2013062454A1 of Sep. 10, 2010 or application US20120070027 of Mar. 22, 2012). The design described uses a magnetic connection between ear cup cushion and the radiator housing. However, this connection provides for creation of a separate magnetic system only for detachable attachment of the ear cup cushion to the headphone housing, and the separate magnetic system by no means is associated with the acoustic radiator and its operation parameters, and therefore complicates the design, and can lead to disturbance with the operation of the radiator and etc.

Therefore, the closer solution to the proposed one is the headphones or headset having an acoustic radiator with a planar magnetic system, since the proposed solution is based on use of a magnetic field formed by this type of radiator.

It is known a design of the isodynamic headphones Oppo PM-1 that is described, for example, under the link http://www.digitalaudioreview.net/2014/05/oppo-pm-1-planar-magnetic-headphones-review-part-2/, which also contains replaceable ear cup cushions that are attached to the headphones housing with the help of a system of protrusions and grooves located along the perimeter of the ear cup cushions.

The design of isodynamic headphones described in application US2015326974A1 of Nov. 12, 2015 is chosen as prototype, in the application the ear cup cushions are mechanically attached to the supporting structure and are connected non-detachably to the isodynamic radiator with a single-sided magnetic system.

However, the attachments of ear cup cushions described above do hot involve use of the magnetic field of an acoustic radiator of isodynamic headphones.

SUMMARY OF THE INVENTION

The object of the invention is to create a design of headphones or a headset with a planar magnetic system that provides a quick-detachable attachment of ear cup cushions to radiators with a possibility to remove the cushions, for example, to replace them by using a magnetic system which has been already created by acoustic radiators with a planar magnetic system that allows to simplify the design of the device and increase the reliability of the connection between the ear cup cushions and the acoustic radiators. An additional objective that is achieved by using the invention is to increase the sensitivity of the acoustic radiator by increasing a value of the magnetic flux in the gap of the radiator which affects the loudness of the sound reproduction by the acoustic radiators when the same level of acoustic signal is given from the sound source.

The invention objective is achieved in such a manner that the known headphones or a headset containing at least one housing with an acoustic radiator with a planar magnetic system placed therein, that is equipped with ear cup cushion located on the outer surface of the radiator according to the invention, the ear cup cushion and the housing is made detachable, and the ear cup cushion is rigidly connected to at least one acoustically transparent ferromagnetic screen connected to the housing by the interaction of the ferromagnetic screen with the magnetic field of the planar magnetic system on the outer surface of the radiator. In this case, the magnetic conductivity of the ferromagnetic screen is sufficient to increase the magnetic induction in the gap of the magnetic system of radiator and to retain the ear cup cushion with a ferromagnetic screen on the housing.

Thus, the invention provides a cumulative technical result, namely a simultaneous and specific increasing of induction both on the outer surface of radiator and in the gap of planar magnetic system, and thus achieving a reliable attachment of the ear cup cushion, and improving acoustic properties (increasing the radiator sensitivity) instead of the expected deterioration thereof, which is unexpected result.

Moreover, the attachment design of the ear cup cushion by means of a magnetic screen is also not obvious, since there is a variant where magnets of planar system attract and hold not only the screen, but also a ferromagnetic ring fixed within a perimeter of the ear cup cushion (for example, similar to the design described in the publication of the international application WO2013062454A1 of Sep. 10, 2010 or application US20120070027 of Mar. 22, 2012), however, in this case the magnetic field of the planar system can be distorted, thus the parameters of the output acoustic signal can be worsen.

Thus, an acoustically transparent screen made of ferromagnetic material and connected to the ear cup cushion by interacting with stray magnetic field of isodynamic acoustic radiator, that is extended beyond the radiator, provides a magnetic attraction of the radiator, and, accordingly, attachment of the ear cup cushion to the radiator. At the same time, the interaction force between the screen and stray magnetic field of the isodynamic acoustic radiator is strong enough for effective connection between ear cup cushion and isodynamic acoustic radiator for attachment, and on other hand, it allows to remove the ear cup cushions from the radiator, for example, for their replacement. For this, an energy of the planar system magnets of the acoustic radiator should be such as to provide sufficient magnetic induction on the outer surface of the acoustic radiator, where the ferromagnetic screen with ear cup cushion will be placed.

In particular, the inventors carried out tests of the claimed design of headphones with isodynamic acoustic radiators. For the tests it was used a two-sided symmetric planar magnetic system containing Nd—Fe—B N52 magnets and 0.8 mm magnetic core, as well as ear cup cushions with a ferromagnetic screen (net) having thickness of 0.5 mm fixed within them and an acoustic transparency of 60%. The tests showed that the magnetic induction of external stray magnetic field of the isodynamic acoustic radiator is 45-50 mT at the parameters set above. This value of the magnetic induction is sufficient to attract a ferromagnetic screen with the specified parameters and ear cup cushion attached to it with a force of at least 2N. At the same time, measurements showed that when the screen was magnetized to the radiator, the external magnetic field of the screen decreased to 16 mT.

Simultaneously, having an obtained effect of the magnetic attachment of the screen with the ear cup cushion and the radiator, the inventors observed increasing of sensitivity of the acoustic radiator by 0.7 dB in comparison with use of similar headphones without a ferromagnetic screen (net). FIG. 10 shows the amplitude-frequency function (AFF) of the test results, which demonstrates the effect of the presence of a ferromagnetic screen on the sensitivity parameter reflected through the sound pressure level (SPL) in dB, namely the curved line (1) corresponds to AFF of headphones without net as ferromagnetic screen, and curved line (2) demonstrates AFF of headphones with net. In particular, at the same level of the acoustic signal of 999 Hz, the sound pressure level SPL for headphones without a net was 96.2 dB, and for headphones with a net—96.9 dB, which indicates increasing of the sensitivity of the acoustic radiator by 0.7 dB when using the net in the headphones design.

The obtained effect of sensitivity increase of acoustic radiator can be explained by the fact that according to the second Kirchhoff's circuit law the magnetic fluxes of a closed magnetic circuit passing through the magnetic core of the radiator and ferromagnetic screen add together, thereby increasing the magnetic conductivity of the outer section of the radiator magnetic circuit and the magnetic induction in the gap of the radiator magnetic system and, as a result, increasing a magnetic flux in the gap of the radiator, which leads to increasing of the sensitivity of the radiator.

According to one of the preferred embodiments of the invention, the ear cup cushion comprises an internal groove disposed parallel to the outer surface of the radiator, and in the groove, edges of the ferromagnetic screen are located in such a way that a groove wall is disposed between the screen and the outer surface of the radiator. The described embodiment allows to increase the reliability of fastening of the screen inside the cushion and to avoid a possible gap between the surface of the ear cup cushion and the magnetic system of the radiator, which are connected, as well as providing for a mechanical contact of the screen with the magnetic system to increase the magnetic induction, and the absence of acoustic distortions of the sound generated by the radiator.

According to yet another preferred embodiment of the invention, the ferromagnetic screen is in the form of a net or a perforated plate. This allows to provide necessary acoustic transparency of the screen. At the same time, the inventors determined that the acoustic transparency of the screen (net or perforated plate) of more than 60% does not introduce frequency distortions into the sound signal, and amplitude-frequency function of the sound pressure level at high frequencies can be formed by a net or a perforated plate with a lower acoustic transparency.

According to yet another preferred embodiment of the invention, the thickness of the ferromagnetic screen is 0.2-1.5 mm. This screen parameter provides the necessary parameters of acoustic transparency, as well as increasing of the magnetic induction necessary to securely attachment of ear cup cushion with screen to the radiator. The said thickness of the ferromagnetic screen has also been determined in terms of technology of producing of the screen as minimally and maximum possible value, while maintaining the parameters of acoustic transparency and increasing magnetic induction.

According to yet another preferred embodiment of the invention, the through-holes area of the ferromagnetic screen is from 40% to 80% of the total screen area, so it allows to get the desired acoustic transparency of the screen not less than 60%.

According to a further preferred embodiment of the invention, the material of the ferromagnetic screen is selected from the group consist of iron, chrome, nickel, cobalt, and/or their compounds and/or their alloys.

BRIEF DESCRIPTION OF THE DRAWINGS

Examples of implementation of headphones or headset with a planar magnetic system are given below and illustrated with the following drawings.

DETAILED DESCRIPTION OF THE EMBODIMENTS

The following examples, as well as the drawings and images provided, do not limit the possible embodiments of the invention, but only explain the invention.

Figure 1:
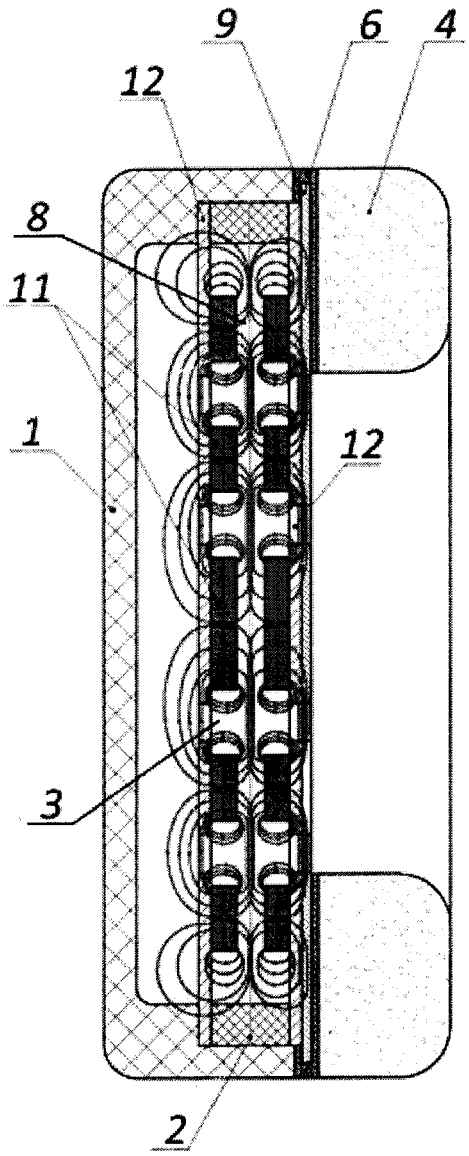
FIG. 1 shows a general cutaway view of the headphones (headset) with a two-sided symmetrical planar magnetic system that contains magnetic cores in a position when the ear cup cushion is connected to the radiator.
Figure 2:
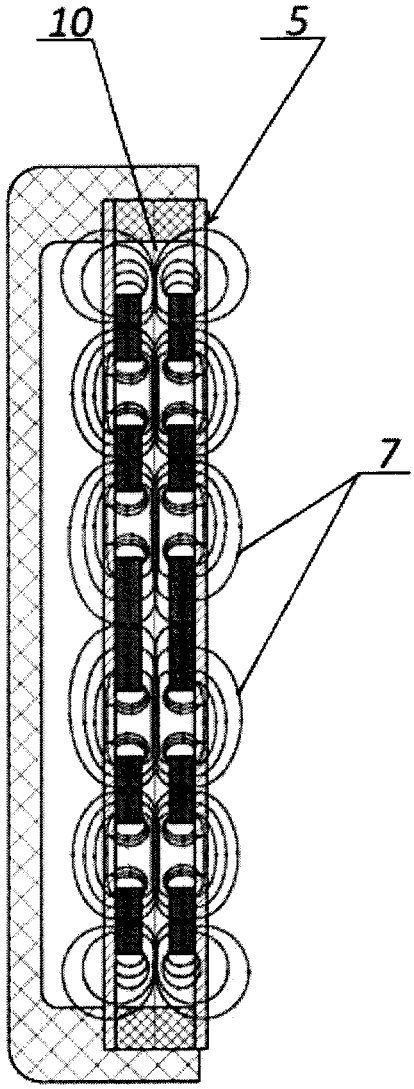
FIG. 2 shows a general cutaway view of radiator of the headphones (headset) with a two-sided symmetrical planar magnetic system that contains magnetic cores in a position when the ear cup cushion is disconnected with the radiator.
Figure 3:
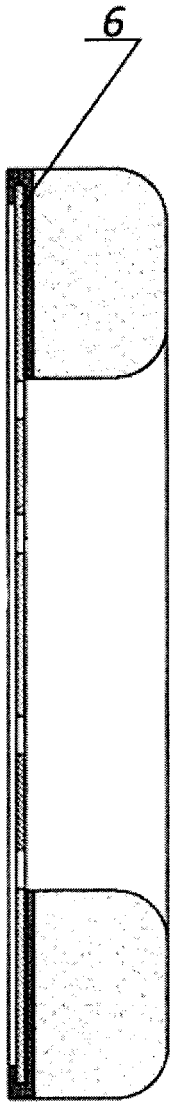
FIG. 3 shows a general cutaway view of ear cup cushion of the headphones (headset) with a two-sided symmetrical planar magnetic system that contains magnetic cores in a position when the ear cup cushion is disconnected with the radiator.
Figure 4:
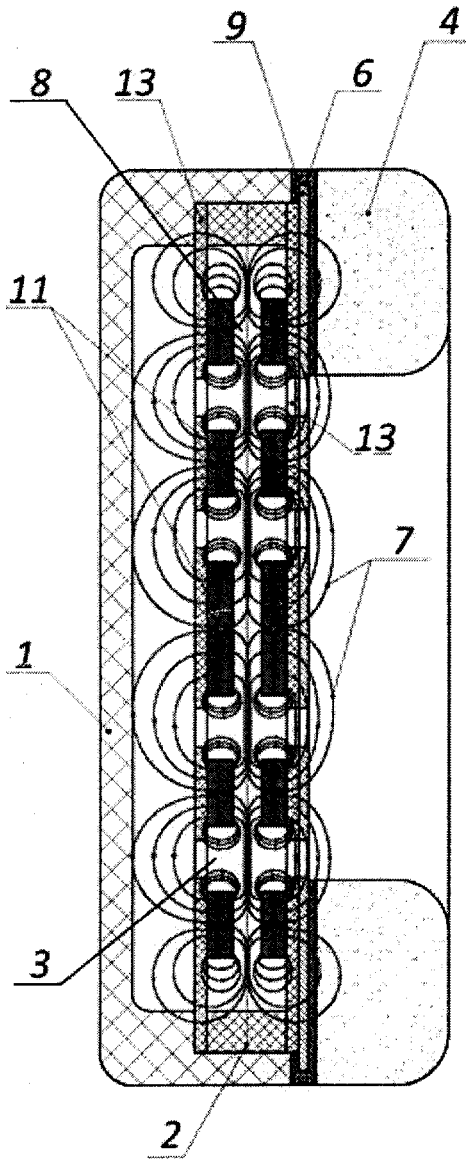
FIG. 4 shows a general cutaway view of the headphones (headset) with a two-sided symmetrical planar magnetic system without magnetic cores in a position when the ear cup cushion is connected to the radiator.
Figure 5:
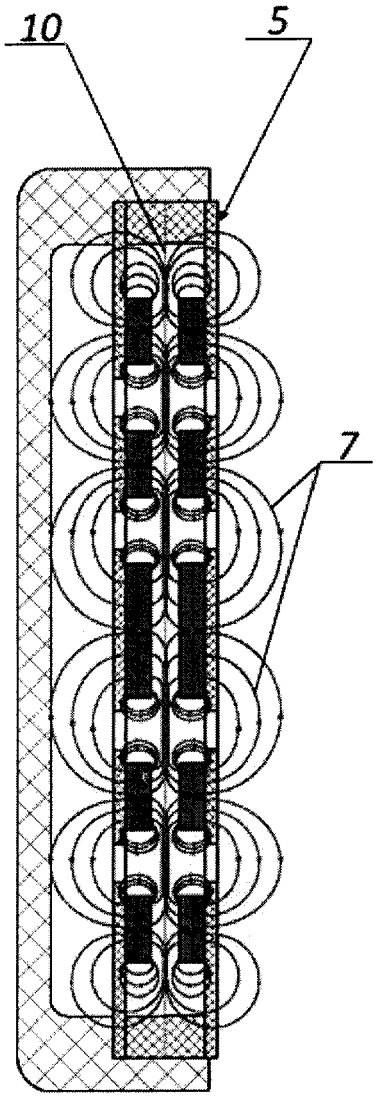
FIG. 5 shows a general cutaway view of radiator of the headphones (headset) with a two-sided symmetrical planar magnetic system without magnetic cores in a position when the ear cup cushion is disconnected with the radiator.
Figure 6:
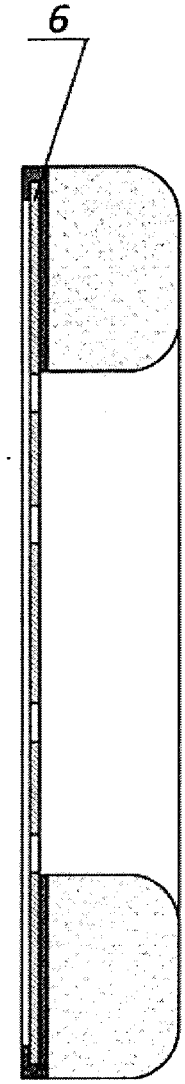
FIG. 6 shows a general cutaway view of ear cup cushion of the headphones (headset) with a two-sided symmetrical planar magnetic system without magnetic cores in a position when the ear cup cushion is disconnected with the radiator.
Figure 7:
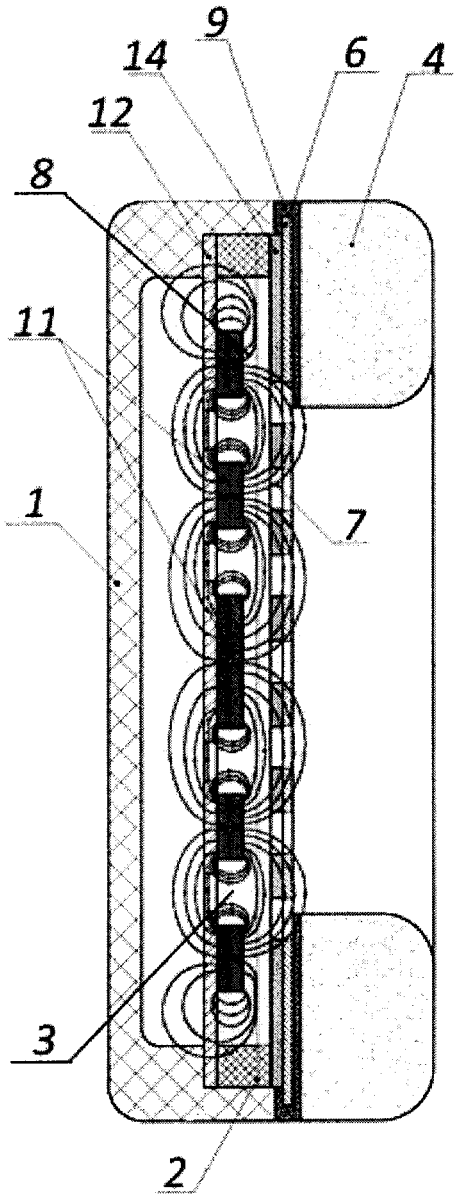
FIG. 7 shows a general cutaway view of the headphones (headset) with a single-sided symmetrical planar magnetic system in a position when the ear cup cushion is connected to the radiator.
Figure 8:
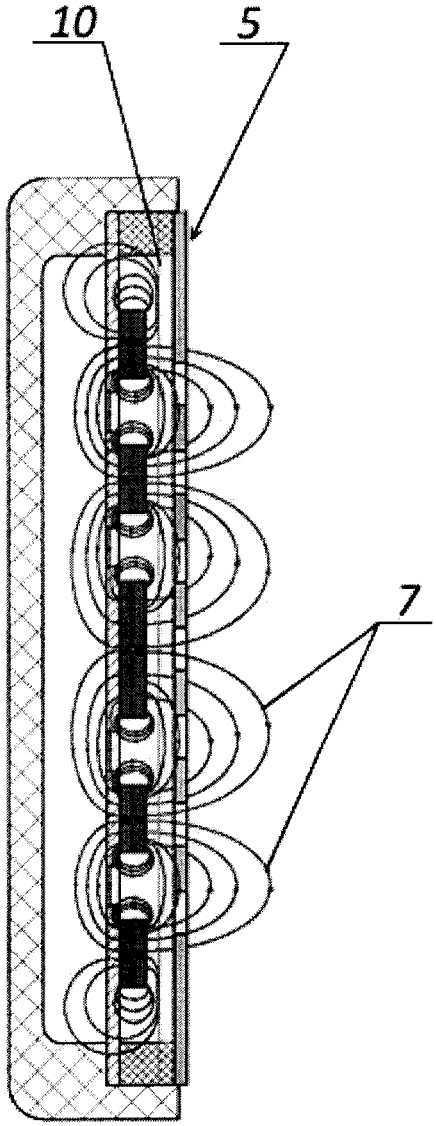
FIG. 8 shows a general cutaway view of radiator of the headphones (headset) with a single-sided symmetrical planar magnetic system in a position when the ear cup cushion is disconnected with the radiator.
Figure 9:
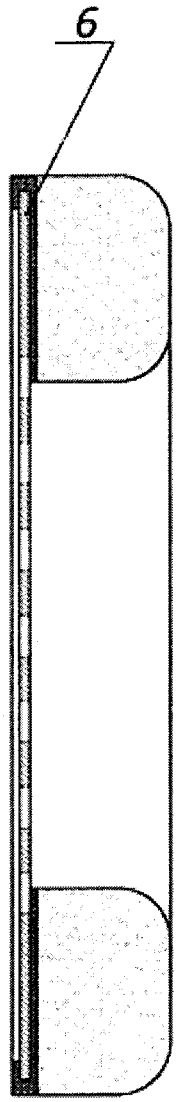
FIG. 9 shows a general cutaway view of ear cup cushion of the headphones (headset) with a single-sided symmetrical planar magnetic system in a position when the ear cup cushion is disconnected with the radiator.
Figure 10:
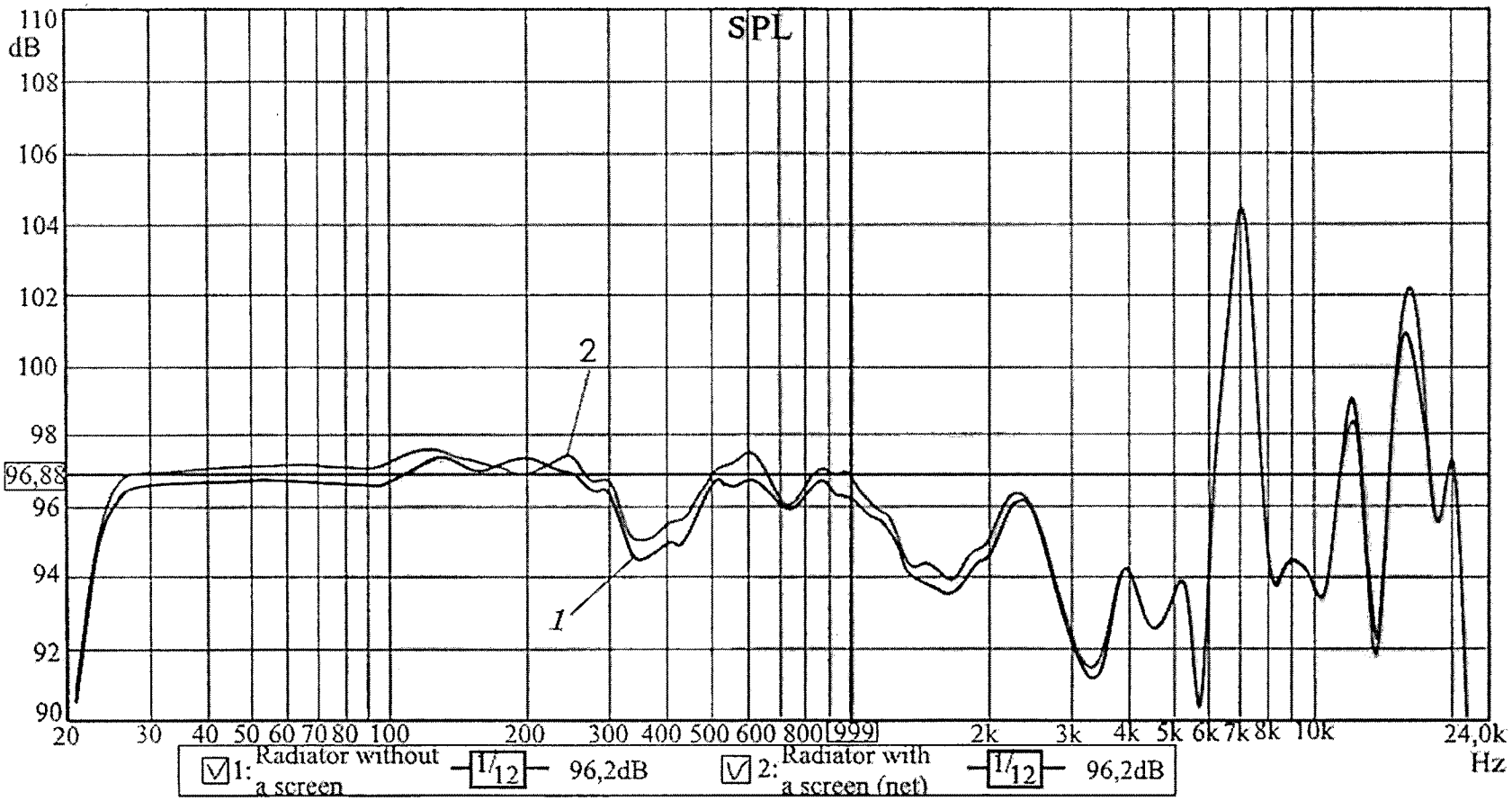
FIG. 10 demonstrates a diagram of AFF of headphones according to the invention using the ferromagnetic screen and without the screen.
Figure 11:
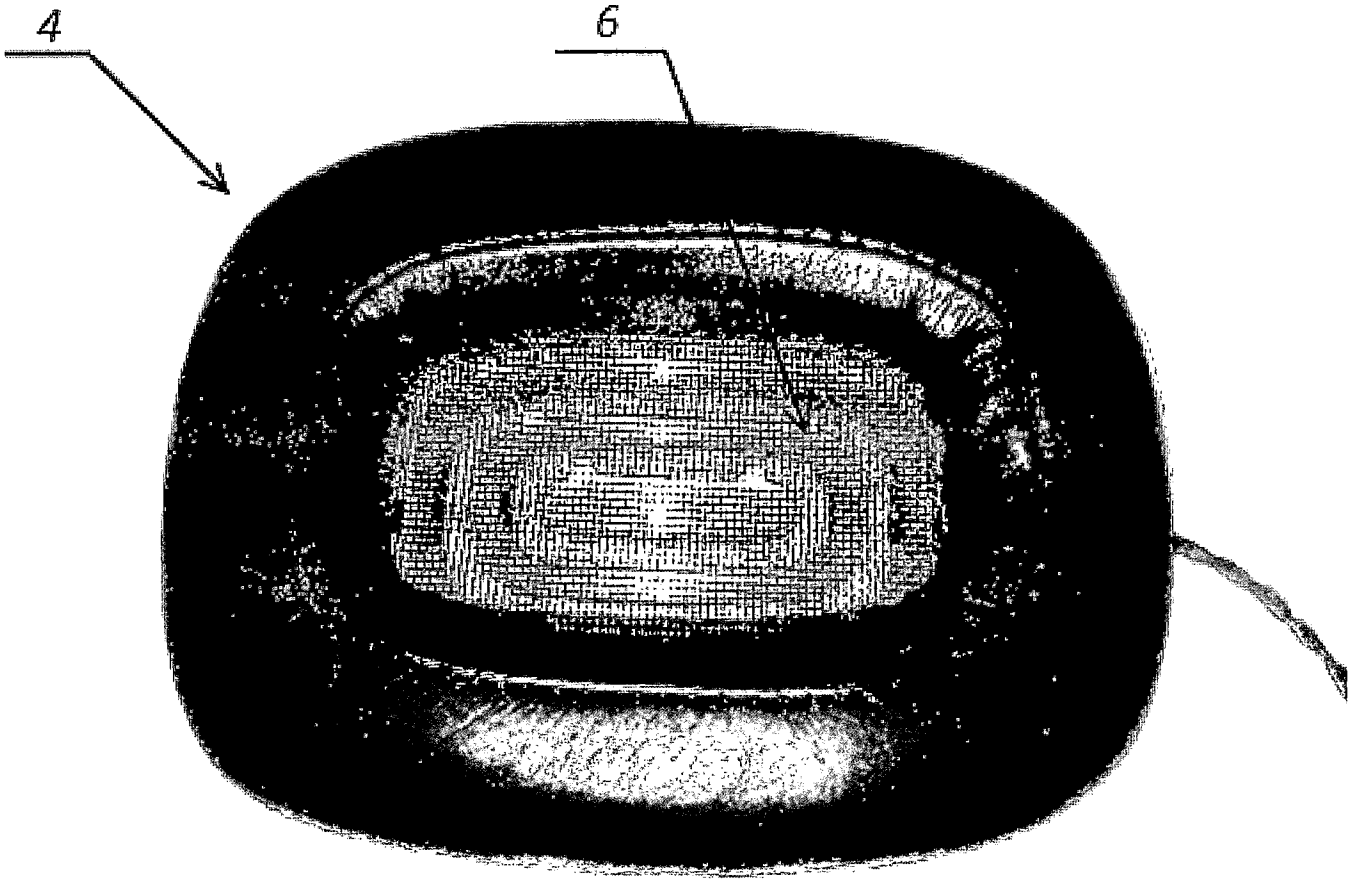
FIGS. 11*a* and 11*b* demonstrate a photo of AFF of headphones according to the invention using (a) the ferromagnetic screen and (b) without the screen.
Figure 11:
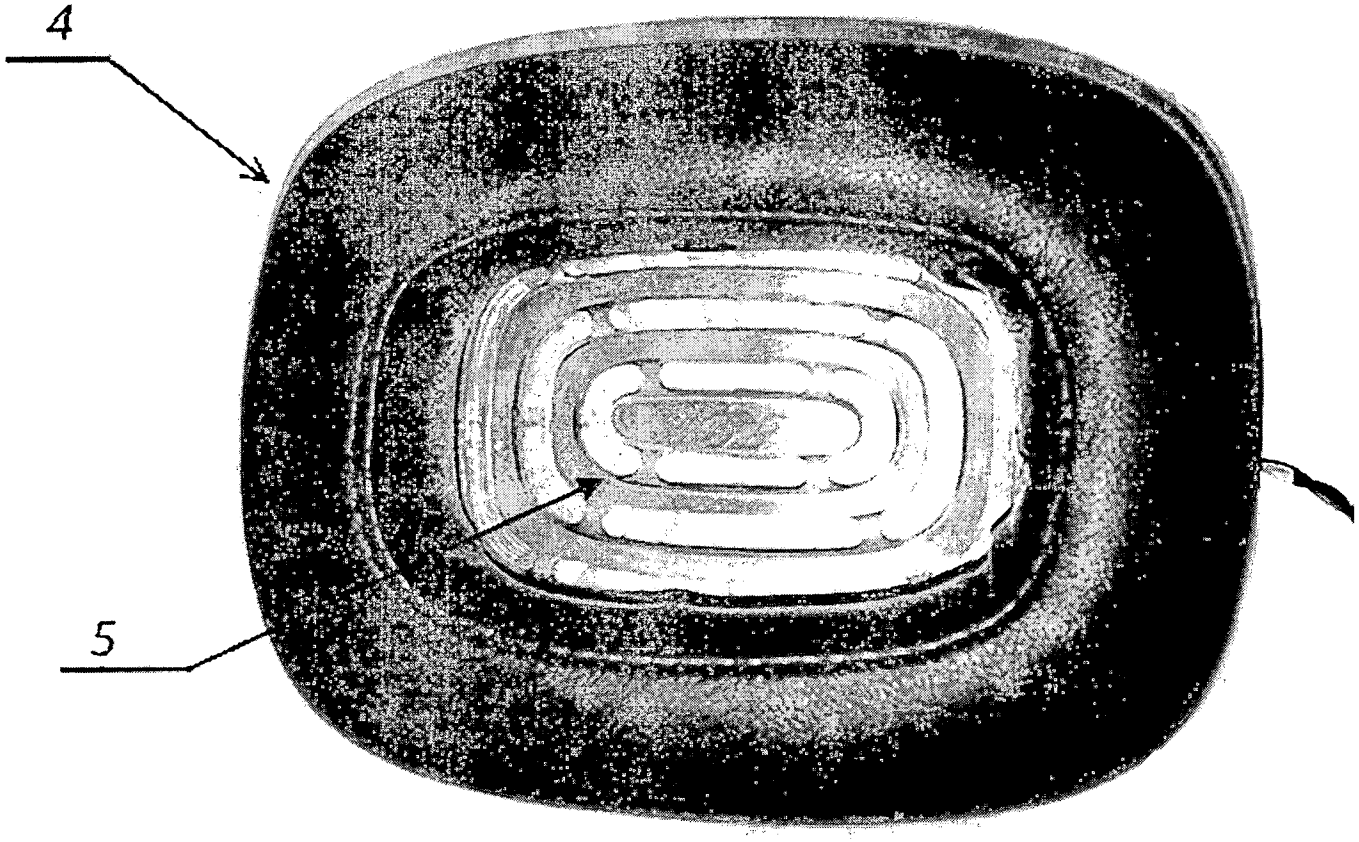

Headphones or headset (FIG. 1-9) comprise of at least one housing 1 with an acoustic radiator 2 with a planar magnetic system 3, equipped with an ear cup cushion 4 located on the outer surface of the radiator 5. The ear cup cushion 4 and housing 1 is performed in disconnected way. The ear cup cushion 4 is rigidly attached to the acoustically transparent ferromagnetic screen 6. The screen 6 can be performed as a decorative net or a decorative perforated plate, and be connected to the housing 1 by the interaction of the ferromagnetic screen with the stray magnetic field 7 of the planar magnetic system 3 on the outer surface of the radiator 5. The ferromagnetic screen 6 has a magnetic conductivity that is sufficient to increase the magnetic induction in the gap 8 of the magnetic system 3 of the radiator 2 and to hold the ear cup cushion 4 with the ferromagnetic screen 6 on the housing 1. In particular, the magnetic induction of the external stray magnetic field 7 of the isodynamic acoustic radiator 2 can be of 45-50 mT in order to attach the screen 6 and the housing 1. The thickness of the ferromagnetic screen 6 is from 0.2 to 1.5 mm, for example 0.8 mm. The through-holes area of the ferromagnetic screen 6 is from 40% to 80% of the total screen area 6, for example 60%. The material of the ferromagnetic screen 6 is selected from the group consisting of iron, chrome, nickel, cobalt, and/or their compounds and/or their alloys.

The ear cup cushion has an outer groove 9 located parallel to the outer surface of the radiator 5. In the groove 9, the edges of the ferromagnetic screen 6 are located in such a way that the wall of the groove 9 is placed between the screen 6 and the outer surface of the radiator 5.

According to one embodiment of a planar magnetic system (which is not the subject of this invention), the headphones or headset comprises a planar magnetic system 3 (FIG. 1-3) performed to be a two-sided symmetrical system relatively to the membrane 10, at least with two rows of magnets 11 located parallel to the outer surface of the radiator 5 between the magnetic cores 12 mounted on both sides of the magnets 11. The magnetic cores 12 are in magnetic saturation, wherein the magnetic flux through each magnetic core 12 is limited by the area of its cross section, and the magnetic field lines 7 are extended beyond the magnetic cores 12.

According to yet another embodiment of a planar magnetic system, the headphones or headset comprises a planar magnetic system 3 (FIG. 4-6) performed to be two-sided symmetrical system without magnetic cores, the system comprises of at least two rows of magnets 11 attached to diamagnetic nonmetallic plates 13 placed on both sides relatively to magnets 11.

According to yet another embodiment of a planar magnetic system, the headphones or headset comprises a planar magnetic system 3 (FIG. 7-9), performed to be one-sided system comprising of one row of magnets 11, on one side of the row a protective perforated plate 14 is placed between the row of magnets 11 and a ferromagnetic screen 6, and on the other side of the row a magnetic core 12 is located.

The headphones or headset with all of the above-mentioned embodiments is used in the following way.

The decorative acoustically transparent screen 6 (plate or net) interacting with the stray magnetic field 7 of the planar magnetic system 3 that is extended beyond the magnetic system, provides a magnetic attraction of the screen 6 to the outer surface of the radiator 5 and, accordingly, the attachment of the ear cup cushion 4 to the housing 1. The energy of the magnets 11 of the acoustic radiator 2 is sufficient to provide a magnetic induction on the outer surface of the radiator 5, where the ferromagnetic screen 6 will be placed with the ear cup cushion 4. When the ear cup cushion 4 is attached to the hosing 1, the ferromagnetic screen 6 located on the outer surface of the radiator 5 increases the magnetic conductivity of the outer portion of the magnetic core of the radiator 2 and increases the magnetic induction in the gap 8 of the magnetic system 3 of the radiator 2 and, accordingly, its sensitivity.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The invention claimed is:

1. Headphones or a headset comprising at least one housing with an acoustic radiator having a planar magnetic system placed therein, comprising an ear cup cushion located on an outer surface of the radiator, the ear cup cushion and the housing being detachably connected, wherein the ear cup cushion is rigidly connected to at least one acoustically transparent ferromagnetic screen connected to the housing by means of an interaction of the ferromagnetic screen with a magnetic field of the planar magnetic system on the outer surface of the radiator, and the magnetic conductivity of the ferromagnetic screen is sufficient to increase magnetic induction in a gap of the magnetic system of the radiator and to hold the ear cup cushion with a ferromagnetic shield on the housing, wherein the ferromagnetic screen is in a form of a net or a perforated plate, and an area of through-holes of the ferromagnetic screen is in the range of 40% to 80% of a total area of the ferromagnetic screen, wherein the ear cup cushion comprises an internal groove disposed in parallel to the outer surface of the radiator, wherein edges of the ferromagnetic screen are located in such a way that a groove wall is located between the screen and the outer surface of the radiator, wherein the ear cup cushion comprises an internal groove disposed in parallel to the outer surface of the radiator, and wherein edges of the ferromagnetic screen are located in such a way that a groove wall is located between the screen and the outer surface of the radiator.

2. The headphones or headset of claim 1, wherein a thickness of the ferromagnetic screen is in the range of 0.2-15 mm.

3. The headphones or headset of claim 1, wherein material of the ferromagnetic screen is selected froth the group consisting of iron, chrome, nickel, cobalt, and compounds and alloys of any of them.

* * * * *